US005778777A

United States Patent [19]

Shibata et al.

[11] Patent Number: 5,778,777

[45] Date of Patent: Jul. 14, 1998

[54] DAMPENDING DEVICE FOR A PRINTING MACHINE

[75] Inventors: Nobuyoshi Shibata; Naoki Ikeda, both of Fuchu, Japan

[73] Assignee: Ryobi Ltd., Hiroshima-ken, Japan

[21] Appl. No.: 855,712

[22] Filed: May 8, 1997

[30] Foreign Application Priority Data

Jun. 6, 1996 [JP] Japan ..... 6-144087

[51] Int. Cl.[6] ..... B41F 7/26; B41F 7/32

[52] U.S. Cl. ..... 101/148

[58] Field of Search ..... 101/350.1, 350.2, 101/350.5, 207, 208, 209, 210, 355, 356, 363, 364, 148, 147; 118/259, 258

[56] References Cited

U.S. PATENT DOCUMENTS 3,769,909 11/1973 Fugman et al. ..... 101/147

4,251,566 2/1981 Gingerich ..... 118/262 X 4,446,814 5/1984 Abendroth et al. ..... 118/262 X

*Primary Examiner*—J. Reed Fisher

*Attorney, Agent, or Firm*—Merchant, Gould, Smith, Edell, Welter and Schmidt

[57] ABSTRACT

A wiper 14 is arranged at a position so as to press to both a side surface 2M of a water fountain roller 2 and a side surface 3M of a metering roller 3. The dampening solution 10 adhered on the side surface 2M and 3M can be scraped off from the side surfaces by the wiper 14. Further, surplus dampening solution 10 stored in a groove 5 formed between the rollers is guided into a water fountain 4. The wiper 14 is made of an elastic body having water retention. So that, lubrication is expected when the dampening solution 10 is absorbed in the wiper 14. Other grooves are formed on the wiper 14 along with edges of a bracket 27 and a bracket 28.

6 Claims, 10 Drawing Sheets

<THE FIRST EMBODIMENT>

<THE FIRST EMBODIMENT>

<THE SECOND EMBODIMENT>

<THE SECOND EMBODIMENT>

<THE THIRD EMBODIMENT>

<THE THIRD EMBODIMENT>

<THE FOURTH EMBODIMENT>

<THE FOURTH EMBODIMENT>

<PRIOR ART>

<PRIOR ART>

<PRIOR ART>

<PRIOR ART>

<PRIOR ART>

DAMPENDING DEVICE FOR A PRINTING MACHINE

CROSS-REFERENCE TO RELATED APPLICATIONS

This application is based on Application No. Hei 8-144087 filed on Jun. 6, 1996 in Japan, the content of which is incorporated hereinto by reference.

BACKGROUND OF INVENTION

1. Field of the Invention

The present invention relates to a dampening device for a printing machine, more specifically, the dampening device for the printing machine which is capable of increasing durability of a contact member such as a wiper and the like, as well as avoiding abrasion of the rollers in the dampening device in addition to carrying out proper printing by preventing oversupply of the dampening solution.

2. Description of the Prior Art

A dampening device for a printing machine is a device for supplying a proper amount of dampening solution to a plate rolled on a plate cylinder. The first known dampening device is shown in FIG. 8. The dampening solution 10 is stored in a water fountain 4, and a water fountain roller 2 is positioned so as to soak the lower part of it in the dampening solution 10. The water fountain roller 2 is rotated by centering around a roller shaft 2J in a direction of arrow 92. Further, a metering roller 3 is provided adjacent to the water fountain roller 2 so as to contact with the water fountain roller. The metering roller 3 is rotated by centering around a roller shaft 3J in a direction of arrow 93.

The dampening solution 10 adhered on the outer surface of the water fountain roller 2 is distributed by rotation of the water fountain roller 2. Then the dampening solution 10 thus adhered is transferred to the metering roller 3. FIG. 7 is a side view showing the relationship of the water fountain roller 2 and the metering roller 3. The dampening solution 10 adhered on the outer surface of the water fountain roller 2 is spread on the outer surface of the water fountain roller 2 as a thin film having an appropriate thickness by the contact between the water fountain roller 2 and the metering roller 3. Then the dampening solution 10 thus spread is transferred on both outer surfaces of the metering roller 3.

In other words, the dampening solution 10 spread uniformly in a direction of the roller shafts adheres on the dampening surface 3W of the metering roller 3 shown in FIG. 7. A plurality of rollers (not shown) are provided adjacent to the metering roller 3. The dampening solution 10 on the metering roller 3 is supplied to the plate rolled on the plate cylinder through the rollers. Surplus dampening solution 10 adhered on the outer surface of the dampening roller 2 is stored into a groove 5 formed between the water fountain roller 2 and the metering roller 3 (hereinafter referred to as roller groove).

Besides, the dampening solution 10 also adheres on both side surfaces 2M of the water fountain roller 2. The dampening solution 10 thus adhered on the side surfaces 2M of the water fountain roller 2 is flowed down in a direction of arrow 90 shown in FIG. 7. So that, sometimes, the dampening solution 10 thus flowed down adheres on the dampening surface 3W of the metering roller 3. Further, the surplus dampening solution 10 stored in the roller groove 5 is flowed from both sides of the roller groove 5 to the side surfaces 2M and both side surfaces 3M and is flowed away in the direction of arrow 90. So that, a part of the surplus dampening solution 10 reaches to the dampening surface 3W of the metering roller 3.

In that case, amount of the dampening solution 10 is increased at both ends of the dampening surface 3W of the metering roller 3. Therefore, the dampening solution 10 is spread on the dampening surface 3W unevenly and is transferred to other rollers positioned adjacently. The dampening solution 10 thus spread unevenly on the dampening surface 3W is finally transferred to the plate. Therefore, proper printing can not be carried out because too much of the dampening solution causes a loss of balance between printing ink and the dampening solution.

Brackets 41 and wipers 42 are provided to the dampening device in order to prevent the flow of the dampening solution to the side surfaces 2M and the side surfaces 3M. The wipers 42 are fixed on the brackets 41, and the wipers 42 are supported by the brackets 41.

The wipers 42 are arranged at a position so as to contact with both the side surfaces 2M of the water fountain roller 2 and the side surfaces 3M of the metering roller 3. Thus, the dampening solution 10 adhered on the side surfaces 2M and 3M is scraped off from the side surfaces. In addition, the dampening solution 10 stored in the roller groove 5 is guided to outside of the rollers via the wipers 42 and the brackets 41 for preventing adherence of the dampening solution on the side surfaces 2M and 3M. The dampening solution 10 thus guided via the wipers 42 and the brackets 41 falls into the water fountain 4.

As described in above, the dampening solution 10 on the side surfaces 2M of the water fountain roller 2 and the side surfaces 3M of the metering roller 3 is scraped off by the wipers 42 by maintaining contact with these rollers. So that, the wipers 42 are made of a material that can be slipped on the side surfaces such as resins or the like The second known dampening device is described hereunder with reference to FIG. 10A and 10B. A plurality of sealing members 64 are provided so as to contact both the side surfaces of the metering roller 3 and a water form roller 61 in the second known dampening device. The dampening solution 10 stored in the water fountain 4 is adhered on the water fountain roller 2, then the dampening solution on the water fountain roller 2 is transferred on the metering roller 3. Thereafter, the dampening solution thus transferred is distributed on the water form roller 61.

A sealing member holder 62 is positioned beside the metering roller 3 and the water form roller 61. The sealing member 64 is held by the sealing member holder 62. Also, the sealing member holder 62 is provided to a pin 63 rotatably. A holder stopper 67 is formed on the sealing member holder 62 in order to fix the sealing member 64 when the sealing member 64 is installed in the dampening device. Further, the sealing member holder 62 is fixed by a safety catch 68 in order to prevent pulling off the sealing member holder 62.

A hole 65 for flowing out the dampening solution (hereinafter referred to as flowing hole 65) is formed on the sealing member 64. The flowing hole 65 is connected to a discharge pass 66 formed between the sealing member 64 and the sealing member holder 62. The surplus dampening solution 10 stored in another roller groove 5 formed between the metering roller 3 and the water form roller 61 is flowed to the discharge pass 66 through the flowing hole 65. The surplus dampening solution 10 thus flowed is guided by the discharge pass 66, and the surplus dampening solution 10 falls into the water fountain 4.

However, the dampening device for a printing machine has the following problems to be resolved. The dampening solution 10 on the side surfaces can not be scraped off properly by the wipers 42 when the position of the side surfaces 2M of the water fountain roller 2 and the side surfaces 3M of the metering roller 3 are arranged so as to be positioned differently from each other in the direction of the shafts.

In other words, it is assumed that a gap having a width of K1 is formed between the water fountain roller 2 and the metering roller 3 as a result of the arrangement of the side surfaces 2M and 3M of the rollers in the direction, of the shafts as shown in FIG. 9A. In that case, the dampening solution 10 flowed on the side surfaces 3M of the metering roller 3 can not be scraped off by the wipers 42 because the wipers 42 do not contact with the side surfaces 3M. Further, the surplus dampening solution 10 stored in the roller groove 5 is flowed down to the side surfaces 3M of the metering roller 3 through the gap having a width of K1.

Consequently, the dampening solution 10 thus flowed down adheres on the dampening surface 3W (see FIG. 7) of the metering roller 3 because the dampening solution 10 thus flowed down reaches to the dampening surface 3W of the metering roller 3.

Precise work and assembly of the rollers are required when the water fountain roller 2 and the metering roller 3 are formed with higher accuracy in their length and alignment of the side surfaces 2M and 3M in order to decrease the gap (having a width of K1) caused between the side surfaces 2M of the water fountain roller 2 and the side surfaces 3M of the metering roller 3.

In addition, either of the water fountain roller 2 or the metering roller 3 is made of rubber. The water fountain roller 2 or the metering roller 3 is abraded by contact with the wipers 42 So that, durability of the water fountain roller 2 or the metering roller 3 is decreased Another gap 44 is formed at a difference in the level between the water fountain roller 2 and the metering roller 3 as shown in FIG. 9B even when the wipers 43 are made by rubber in order to resolve the problem caused by the gap shown in FIG. 9A. As a consequence, the dampening solution 10 is flowed down to the side surfaces 3M of the metering roller 3 through the gap 44. Therefore, the dampening solution 10 thus flowed down adheres on the dampening surface 3W of the metering roller 3 because the dampening solution 10 thus flowed down reaches to the dampening surface 3W of the metering roller 3.

Durability of the wipers is decreased as a result of friction caused between the wipers 43 and the fountain roller 2 or between the wipers 43 and the metering roller 3 when the wipers 43 are made of a soft material such as rubber and the like.

The second known dampening device shown in FIG. 10A and 10B has the same problems. That is, the dampening solution 10 can not be guided properly into the discharge pass 66 because the dampening solution 10 is flowed down through the gap formed between the wipers and the water form roller 61 and the metering roller 3 when the side surfaces of the water form roller 61 and the side surfaces of the metering roller 3 are arranged so as to be positioned differently from each other in the direction of the shafts.

Further, either of the metering roller 3 or the water form roller 61 is made of rubber. The metering roller 3 or the water form roller 61 is abraded by contact with the wipers So that, durability of the metering roller 3 or the water form roller 61 is decreased. Still further, the second known dampening device becomes a complex structure because a plurality of parts such as the sealing member 64, the sealing member holder 62, the safety catch 68 and the like are used as shown in FIG. 10A and 10B As a consequence, it requires too much work to assemble the second known dampening device.

SUMMARY OF TEE INVENTION

It is an object of the present invention to provide a dampening device for a printing machine having a simple structure which is capable of increasing the durability of a contact member such as a wiper and the like as well as avoiding abrasion of the rollers, in addition to carrying out proper printing by preventing an oversupply of the dampening solution.

In accordance with characteristics of the present invention, a dampening device for a printing machine comprises:

a first roller rotated by centering around a first roller shaft, and dampening solution being adhered on the outer surface of the first roller, a second roller positioned adjacent to the first roller and being rotated by a second roller shaft located substantially parallel to the first roller shaft, and the dampening solution adhered on the first roller being transferred to the outer surface of the second roller, and a contact member made of an elastic body having water retention, the contact member being provided so as to contact both a first roller lateral face and a second roller lateral face, the first roller lateral face being located substantially perpendicular to the first roller shaft of the first roller and the second roller lateral face being located substantially perpendicular to the second roller shaft of the second roller.

While the novel features of the invention are set forth in a general fashion, both as to organization and content, it will be better understood and appreciated, along with other objects and features thereof, from the following detailed description taken in conjunction with the drawings.

DETAILED DESCRIPTION OF THE PREFERRED EMBODIMENT

Figure 6:
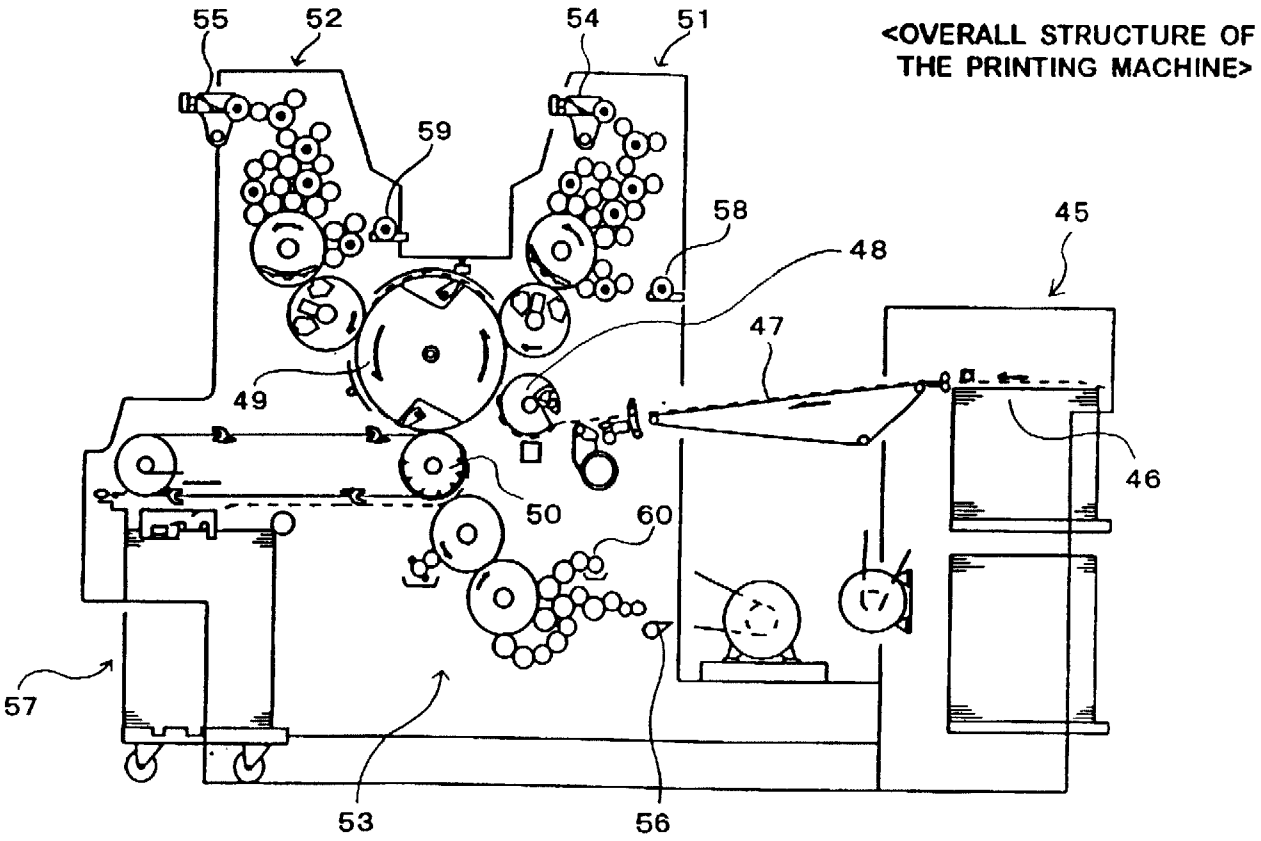
FIG. 6 is a aide view showing overall structure of a sheet-fed offset press.
Figure 7:
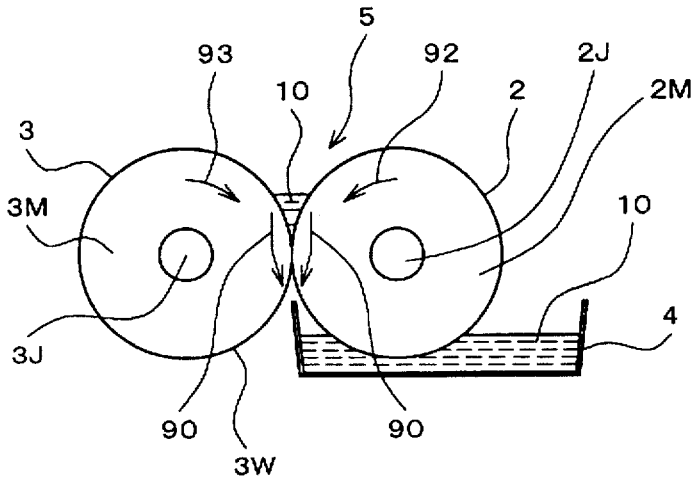
FIG. 7 is a side view showing a relationship of a water fountain roller 2 and a metering roller 3.
Figure 8:
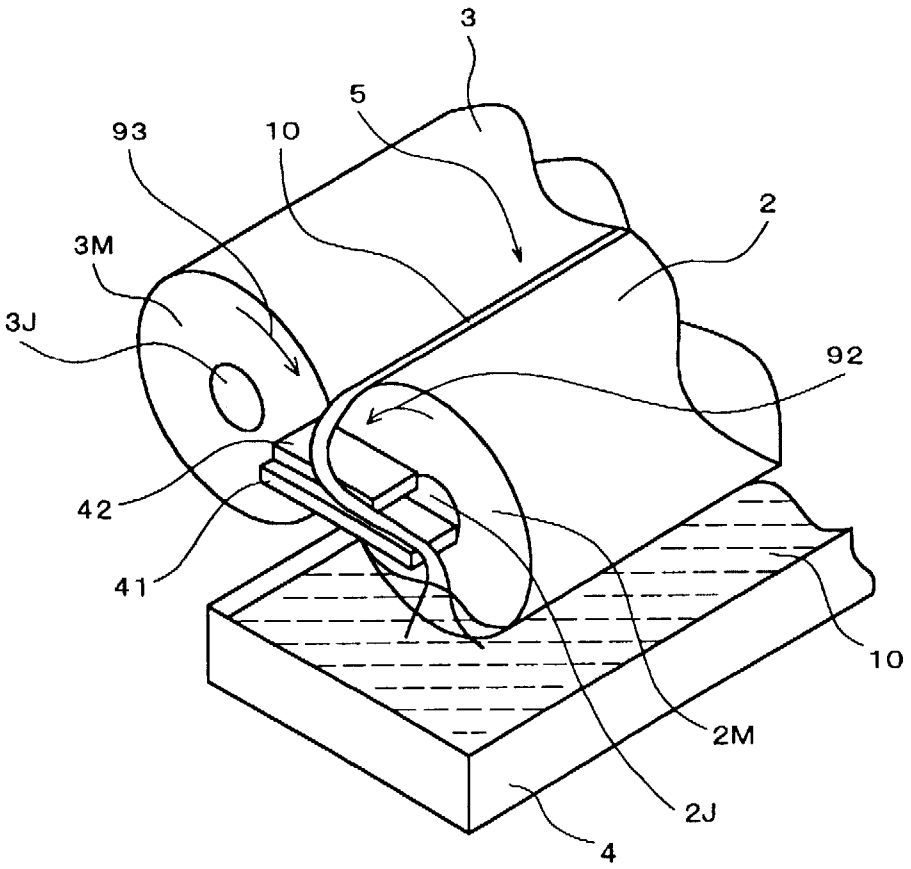
FIG. 8 is a perspective view showing the first known dampening device.
Figure 9A:
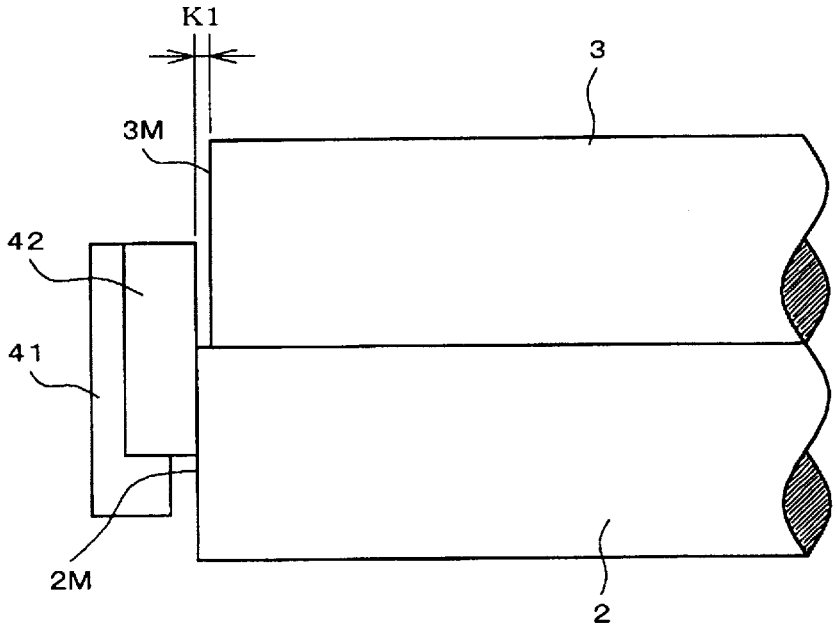
FIG. 9A is a plain view showing a gap formed between the water fountain roller 2 and the metering roller 3 in the first known dampening device.
Figure 9B:
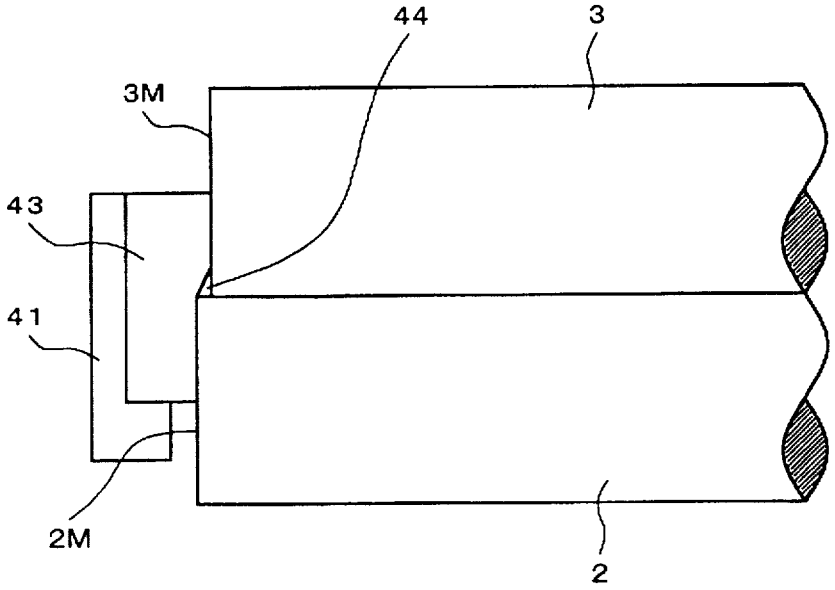
FIG. 9B is a plain view showing another gap formed at a difference in levels between the water fountain roller 2 and the metering roller 3 in the first known dampening device
Figure 10A:
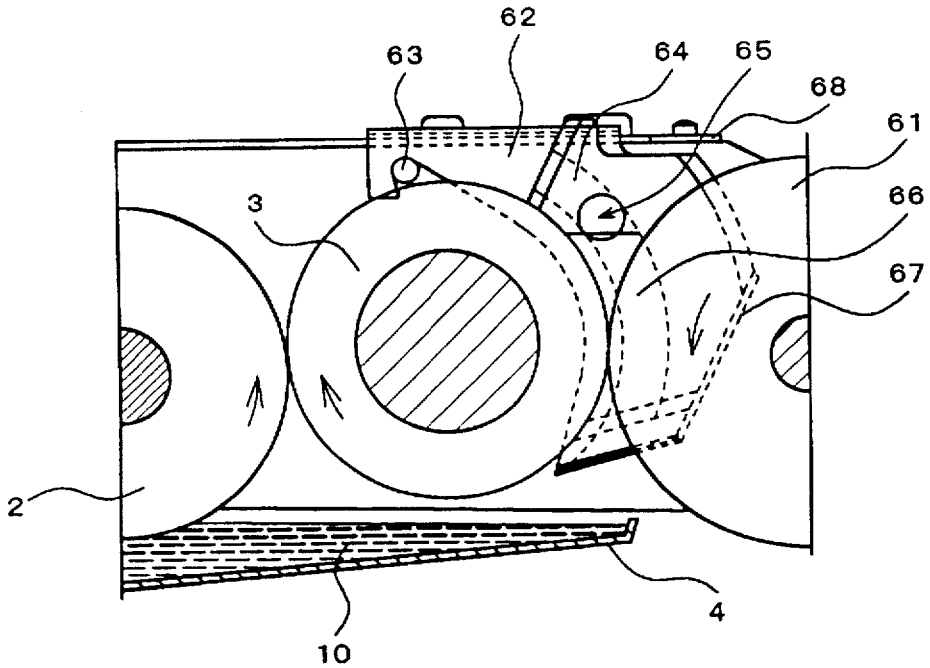
FIG. 10A is a side view showing the second known dampening device.
Figure 10B:
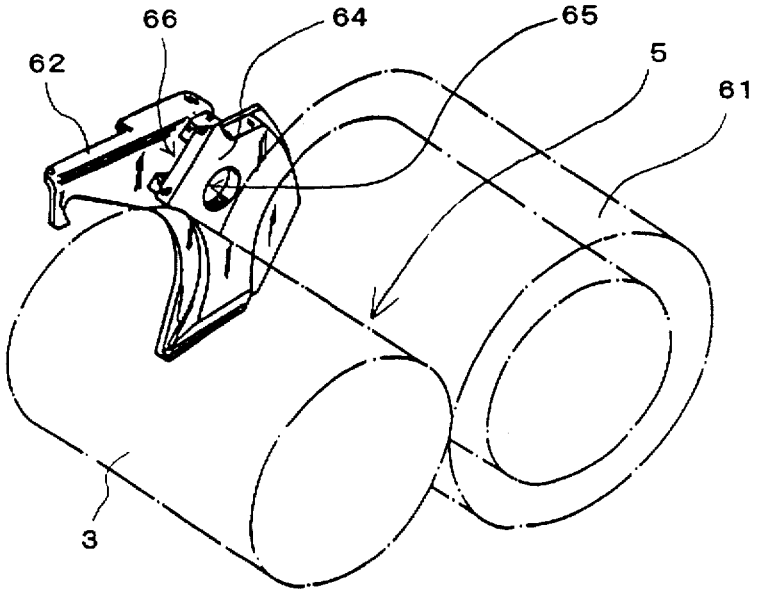
FIG. 10B is a perspective view showing the second known dampening device.

The present invention is applied to a dampening device of a sheet fed offset press (printing machine) in an embodiment described herein. The overall structure of the sheet-fed offset press will be described with reference to FIG. 6. The sheet-fed offset press shown in FIG. 6 is a satellite perfecting printing system which carries out printing in two-colors on the front and single-color on the back, all in one sheet pass. Printing paper 46 for sheet-fed press (hereinafter referred to as papers) positioned on a feeder 45 is fed one sheet after the other through a feeder board 47. The paper 46 thus fed is guided to the paper feed drum 48. Then the paper 46 is delivered to a delivery section 57 after feeding through an impression cylinder 49 for front side printing and another impression cylinder 50 for back side printing.

Perfecting printing is carried out on the papers 46 during the feeding and the delivery by printing units 51, 52 for printing the front side and a printing unit 53 for printing the back side. Each of the printing units 51, 52 for printing the front side and the printing unit 53 for printing the back side has ink supply devices 54, 55, 56 respectively. Ink for printing is fed by the ink supply devices 54, 55, 56. Further, the front surface printing section 51, 52 and the back side printing section 53 comprises dampening devices 58, 59, 60 respectively for supplying dampening solution.

The ink and the dampening solution being fed and supplied by each of the ink supply devices and the dampening devices are provided to each of the plates rolled on plate cylinders of the front surface printing section 51, 52 and the back side printing section 53. Printing is carried out on the papers 46 by utilizing hydrophobicity of the ink with the dampening solution The embodiments described hereinbelow are examples that the present invention is applied to the dampening devices 58, 59, 60.

Figure 1A:
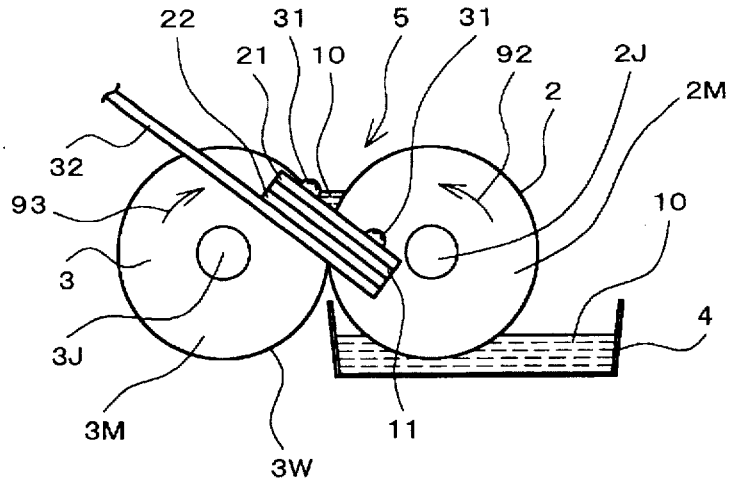
FIG. 1A is a side view showing the first embodiment of a dampening device for a printing machine in the present invention.
Figure 1B:
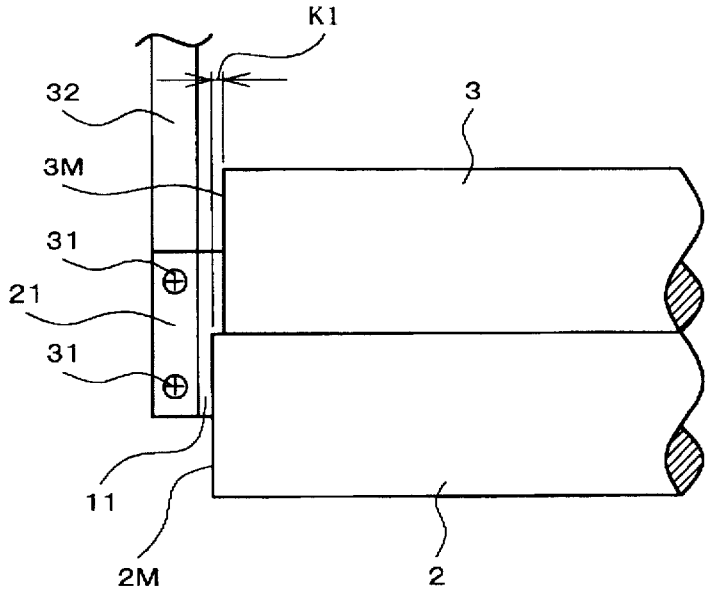
FIG. 1B is a plane view showing the first embodiment of the dampening device in the present invention.

The first embodiment of the dampening device in the present invention will be described in accordance with FIG. 1A and FIG. 1B. FIG. 1A is a side view showing the first embodiment of a dampening device for a printing machine in the present invention. And FIG. 1B is a plane view showing the first embodiment of the dampening device in the present invention. A certain amount of dampening solution 10 is stored in a water fountain 4 as a dampening solution storing part. A water fountain roller 2 (first roller) is provided so as to be soaked in the dampening solution 10. The water fountain roller 2 is rotated by centering around a roller shaft 2J (first roller shaft) in the direction of arrow 92. As a result of the rotation, the dampening solution 10 adheres on the outer surface of the water fountain roller 2.

Further, a metering roller 3 (second roller) is provided adjacent to the water fountain roller 2. Also, a roller shaft 3J (second roller shaft) of the metering roller 3 is positioned substantially parallel to the roller shaft 2J. The metering roller 3 is rotated by centering around the roller shaft 3J in the direction of arrow 93. Thus, the dampening solution 10 adhered on the outer surface of the water fountain roller 2 is transferred to the metering roller 3.

The dampening solution 10 adhered on the outer surface of the water fountain roller 2 is spread on the outer surface of the water fountain roller 2 as a thin film having an appropriate thickness by the contact between the water fountain roller 2 and the metering roller 3 Then the dampening solution thus spread is transferred to a dampening surface 3W of the metering roller 3 uniformly in the direction of the roller shafts.

As shown in FIG. 1A, a roller groove 5 is formed between the water fountain roller 2 and the metering roller 3. Surplus dampening solution 10 adhered on the outer surface of the dampening roller 2 is stored into the roller groove 5. A plurality of rollers (not shown) are provided adjacent to the metering roller 3. The dampening solution 10 on the metering roller 3 is supplied to each of the plates rolled on the plate cylinders through the rollers.

A wiper (contact member) 11 is arranged at a position so an to contact both the side surface 2M (first roller lateral face) of the water fountain roller 2 and the side surface 3M (second roller lateral face) of the metering roller 3. The wiper 11 is interposed between a bracket 21 (first fixing member) and another bracket 22 (second fixing member) so as to be fixed therebetween. In addition, the wiper 11, the bracket 21 and the bracket 22 are fixed to a supporting plate 32 with a plurality of bolts 31. The supporting plate 32 is fixed to a frame of the printing machine. Also, the wiper 11 is arranged at a position so as to contact both the side surfaces 2M, 3M of the water fountain roller 2 and the metering roller 3.

The dampening solution 10 adhered on the side surfaces 2M and 3M can be scraped off from the side surfaces because of maintaining the contact between the side surfaces. The dampening solution 10 stored in the roller groove 5 and flowed away toward a direction parallel to the roller shafts is caught by an upper surface of the wiper 11. The wiper 11 is provided so as to decline downwardly to the water fountain roller 2. Thus, the dampening solution 10 flowed away from the roller groove 5 is fallen down to the water fountain 4 through the upper surface and the declined part of the wiper 11.

As described above, the surplus dampening solution 10 is not adhered on the dampening surface 3W of the metering roller 3 through the side surface 2M and the side surface 3M by arranging the wiper 11 so as to contact both the side surface 2M and the side surface 3M. Thus, oversupply of the dampening solution 10 can be avoided by preventing increase of supply of the dampening solution 10 at both ends of the dampening surface 3W of the metering roller 3.

It is not necessary for the dampening device to equip a pan for collecting the dampening solution separate from the water fountain 4 since the surplus dampening solution 10 flowed away from the roller groove 5 is fallen down to the water fountain 4.

In this embodiment, the wiper 11 is made of a form material. Also, the material has elasticity and water retention. The wiper 11 is arranged so as to press against the side surface 2M of the water fountain roller 2 and the side surface 3M of the metering roller 3

The gap having a width of K1 formed between the side surface 2M and the side surface 3M shown in FIG. 1B is covered with the wiper 11 because of elasticity of the wiper 11 even when the side surface 2M of the water fountain roller 2 and the side surface 3M of the metering roller 3 are arranged so as to be positioned differently from each other in the direction of the roller shafts. Thus, the gap is not formed between the wiper 11 and the side surface 3M. Therefore, the dampening solution 10 stored in the roller groove 5 is not flowed away on the side surface 3M even when the side surface 2M of the water fountain roller 2 and the side surface 3M of the metering roller 3 are arranged so as to be positioned differently from each other in the direction of the roller shafts.

The wiper 11 made of the form material has a great number of pores in it, so that the wiper 11 has excellent water retention Thus, a large amount of the dampening solution 10 is absorbed into the wiper 11. Hence, friction resistance between the wiper 11 and the side surface 2M, and between the wiper 11 and the side surface 3M is decreased by lubrication facilitated with the dampening solution 10 thus absorbed Therefore, durability of the wiper 11 is increased as a result of preventing abrasion of the wiper 11.

Further, the dampening device in this embodiment has a very simple structure such that the wiper 11 is fixed to the supporting plate 32 solely with the bolts 31. Thus, the simplified structure described above makes the assembly work easier, so that the manufacturing cost of the dampening device is suppressed. Also, the simplified structure helps to manufacture the dampening device in a low profile because not much space for various parts is required In addition, exchange of the wiper 11 can be carried out efficiently because removal and attachment of the wiper 11 is carried out easily.

Although, the description of the first embodiment stated above describes the wiper 11 which contacts both the side surface 2M and the side surface 3M located on one side of the water fountain roller 2 and the metering roller 3, another wiper 11 which contacts the other side surface 2M and the other side surface 3M located on the other side of the water fountain roller 2 and the metering roller 3. In other words, a pair of wipers 11 are provided on both sides of the water fountain roller 2 and the metering roller 3.

Figure 2A:
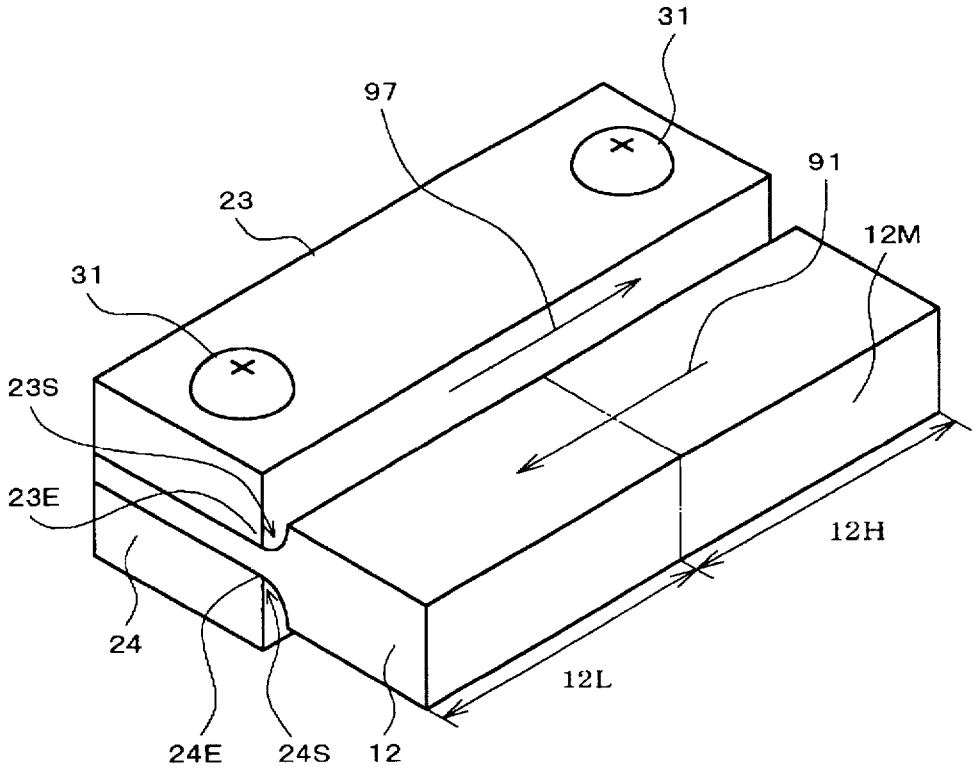
FIG. 2A is a perspective view showing a wiper 12 and peripherals of the dampening device in the second embodiment of the present invention.
Figure 2B:
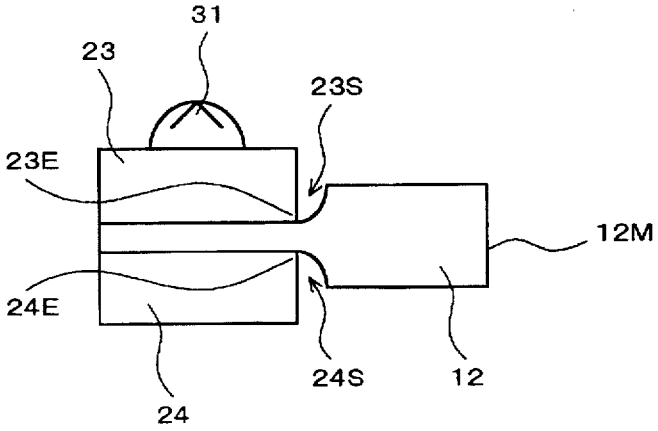
FIG. 2B is a side view showing the wiper 12 and the peripherals of the dampening device in the second embodiment of the present invention

The second embodiment of the dampening device in the present invention will be described in accordance with FIG. 2A and FIG. 2B. FIG. 2A is a perspective view showing a wiper 12 and peripherals of the dampening device. FIG. 2B is a side view showing the wiper 12 and the peripherals. The wiper 12 (contact member) is interposed between a bracket 23 (first fixing member) and another bracket 24 (second fixing member) so as to be fixed therebetween in the dampening device for the printing machine of this embodiment In addition, a part of the wiper 12 is compressed with both the bracket 23, 24 by screwing the bolts 31 passed therethrough.

Also, the wiper 12 is arranged so as to press a contact surface 12M of the wiper 12 against the side surface 2M of the water fountain roller 2 and the side surface 3M of the metering roller 3. The outstanding structure of the dampening device in this embodiment is the same as the first embodiment shown in FIG. 1A and FIG. 1B.

A groove 23S and another groove 24S (hereinafter referred to as wiper grooves) as concave grooves are formed on the wiper 12 along with an edge 23E of the bracket 23 and an edge 24E of the bracket 24, because part of the wiper 12 is compressed with the bracket 23 and the bracket 24 by screwing the bolts 31

In this embodiment, additional amount of the dampening solution 10 is stored in the wiper groove 23S and the wiper groove 24S even when the dampening solution 10 is absorbed in the wiper 12. Thus, water retention of the wiper 12 can be increased further.

As shown in the first embodiment illustrated in FIG. 1A and FIG. 1B, the wiper 12 is provided so as to decline downwardly to the water fountain roller 2. An upper region 12H and a lower region 12L of the wiper 12 shown in FIG. 2A are arranged so as to contact with the side surface 3M of the metering roller 3 and the side surface 2M of the water fountain roller 2 respectively.

The dampening solution 10 absorbed into the wiper 12 has a tendency to flow away in the direction of arrow 91 because the wiper 12 is provided so as to decline downwardly to the water fountain roller 2. Thus, less dampening solution is absorbed in the upper region 12H in comparison with the lower region 12L. So that, there is a probability to cause abrasion of the upper region 12H of the wiper 12 between the side surface 3M by rotation of the metering roller 3 since insufficient lubrication is expected between the upper region 12H and the side surface 3M.

On the contrary, the upper region 12H in the second embodiment shown in FIG. 2A and FIG. 2B has sufficient water retention because additional amount of the dampening solution 10 is stored in the wiper groove 23S and the wiper groove 24S. In other words, the dampening solution 10 stored in the wiper groove 23S, the wiper groove 24S and vicinity of the grooves is moved in a direction of arrow 97 along with the wiper groove 23S and the wiper groove 24S by capillarity.

The dampening solution 10 thus moved is spread over the upper region 12H. Thus, sufficient lubrication is expected between the contact surface 12M of the wiper 12 and the side surface 2M, and between the contact surface 12M and the side surface 3M because enough amount of the dampening solution 10 is always stored in the entire wiper 12.

Although the description of the second embodiment stated above describes the wiper 12 which contacts both the side surface 2M and the side surface 3M located on one side of the water fountain roller 2 and the metering roller 3, another wiper 12 which contacts the other side surface 2M and the other side surface 3M is located on the other side of the water fountain roller 2 and the metering roller 3 In other words, a pair of wipers 12 are provided on both sides of the water fountain roller 2 and the metering roller 3.

Figure 3A:
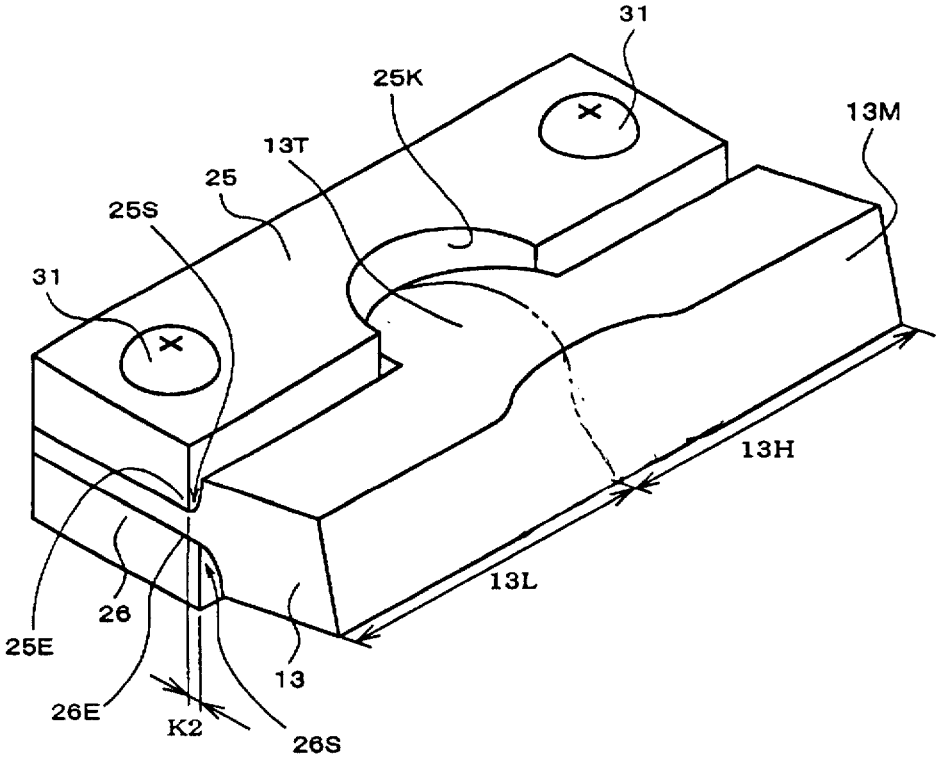
FIG. 3A is a perspective view showing a wiper 13 and peripherals of the dampening device in the third embodiment of the present invention.
Figure 3B:
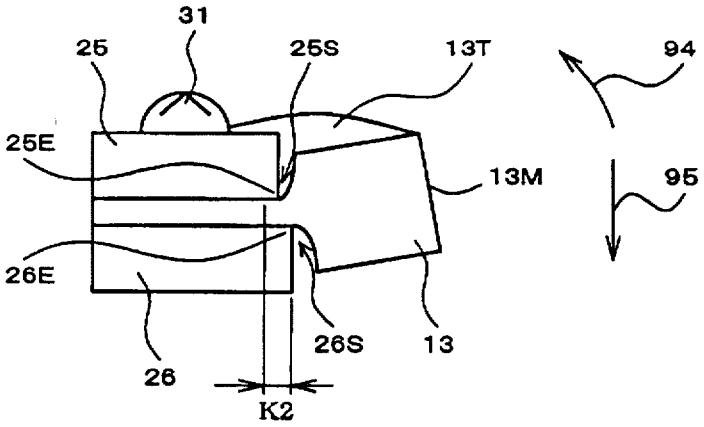
FIG. 3B is a side view showing the wiper 13 and the peripherals of the dampening device in the third embodiment of the present invention.

Further, the third embodiment of the dampening device in the present invention will be described in accordance with FIG. 3A and FIG. 3B. FIG. 3A is a perspective view showing a wiper 13 and peripherals of the dampening device in the third embodiment of the present invention FIG. 3B is a side view showing the wiper 13 and the peripherals. The wiper 13 (contact member) is interposed between a bracket 25 (first fixing member) and another bracket 26 (second fixing member) so as to be fixed therebetween with the bolts 31, and the wiper 13 is compressed with both the bracket 25, 26 by screwing the bolts passed therethrough as described in the second embodiment of the present invention.

Thus, a wiper groove 25S and another wiper groove 26S as concave grooves are formed on the wiper 13 along with an edge 25E of the bracket 25 and an edge 26E of the bracket 26 as a result of interposing a part of the wiper 13 between the bracket 25 and the bracket 26 so as to be fixed therebetween. In this embodiment, the bracket 26 is formed longer than the bracket 25 for a length of K2. A forward portion of the wiper 13, in other words, a portion positioned near a contact surface 13M of the wiper 13 is pushed by the edge 26E.

Hence, the wiper 13 is interposed between the bracket 25 and the bracket 26 when both the edge 25E and the edge 26E are positioned differently from each other. And, a force is applied to the wiper 13 with the bracket 26 and the bracket 25. So that, the forward portion of the wiper 13 is bent slightly in a direction of arrow 94 (a direction to be bent) as shown in FIG. 3B.

The contact surface 13M of the wiper 13 is pulled in a direction of arrow 95 shown in FIG. 3B by the rotation of both the water fountain roller 2 and the metering roller 3 in the direction of arrow 92 and 93. That is, the direction to be bent (the direction of arrow 94) is a direction opposite to the rotation (the direction of arrow 95) of the water fountain roller 2 and the metering roller 3. Thus, the wiper 13 maintains its appropriate direction to the side surface 2M and the side surface 3M even when the wiper 13 is pulled toward the direction of arrow 95 by the rotation of the water fountain roller 2 and the metering roller 3. Because the wiper 13 has already been bent in the direction of arrow 94.

An angle of bend in the direction of arrow 94 is determined in accordance with the length K2 generated by the difference between the bracket 25 and the bracket 26. Thus, the angle of bend of the wiper 13 can be controlled by adjusting the length K2.

Further, a cutout part 25K in a U-shape (hereinafter referred to as cutout part 25K) is formed at approximately the center of the bracket 25 in this embodiment. Thus, the wiper groove 25S located along with the edge 25E is formed along all the way around the cutout part 25K. So that, the amount of the dampening solution stored in the wiper groove 25S is increased by forming the wiper groove 25S longer than the wiper groove 23S shown in FIG. 2A as described in the second embodiment.

Still further, a projection part 13T mated with the cutout part 25K is formed on the wiper 13 as a result of forming the cutout part 25K on the bracket 25. The projection part 13T is located at a position where the dampening solution 10 flowed away from the roller groove 5 always pass through it. Thus, additional amount of the dampening solution can be absorbed and be stored in the projection part 13T.

The amount of the dampening solution 10 flowed upwardly along with the wiper groove 25S is increased by storing additional dampening solution 10 in the projection part 13T. Thus, sufficient amount of the dampening solution 10 can be absorbed even in the forward end of an upper region 13H of the wiper 13. Therefore, sufficient lubrication at the upper region 13H is expected.

In addition, it is hard to deform the shape of the wiper 13 by forming the projection part 13T as a result of providing the cutout part 25K on the bracket 25 Further, the shape of the wiper 13 can be kept more stably because the projection part 13T is formed at approximately the center of the wiper 13 as shown in FIG. 3A.

Although the cutout part 25K is formed as U-shape in this embodiment, the cutout 25K can be formed in other shapes such as V-shape or the like. Though the cutout part 25K is formed solely on the bracket 25 in this embodiment, another cutout part similar to the cutout part 25K can also be formed on the bracket 26 as well as forming another projection part similar to the projection part 13T on the wiper 13.

Although the description of the third embodiment stated above describes the wiper 13 which contacts both the side surface 2M and the side surface 3M located on one side of the water fountain roller 2 and the metering roller 3, another wiper 13 which contacts the other side surface 2M and the other side surface 3M is located on the other side of the water fountain roller 2 and the metering roller 3. In other words, a pair of wipers 13 are provided on both sides of the water fountain roller 2 and the metering roller 3.

Figure 4:
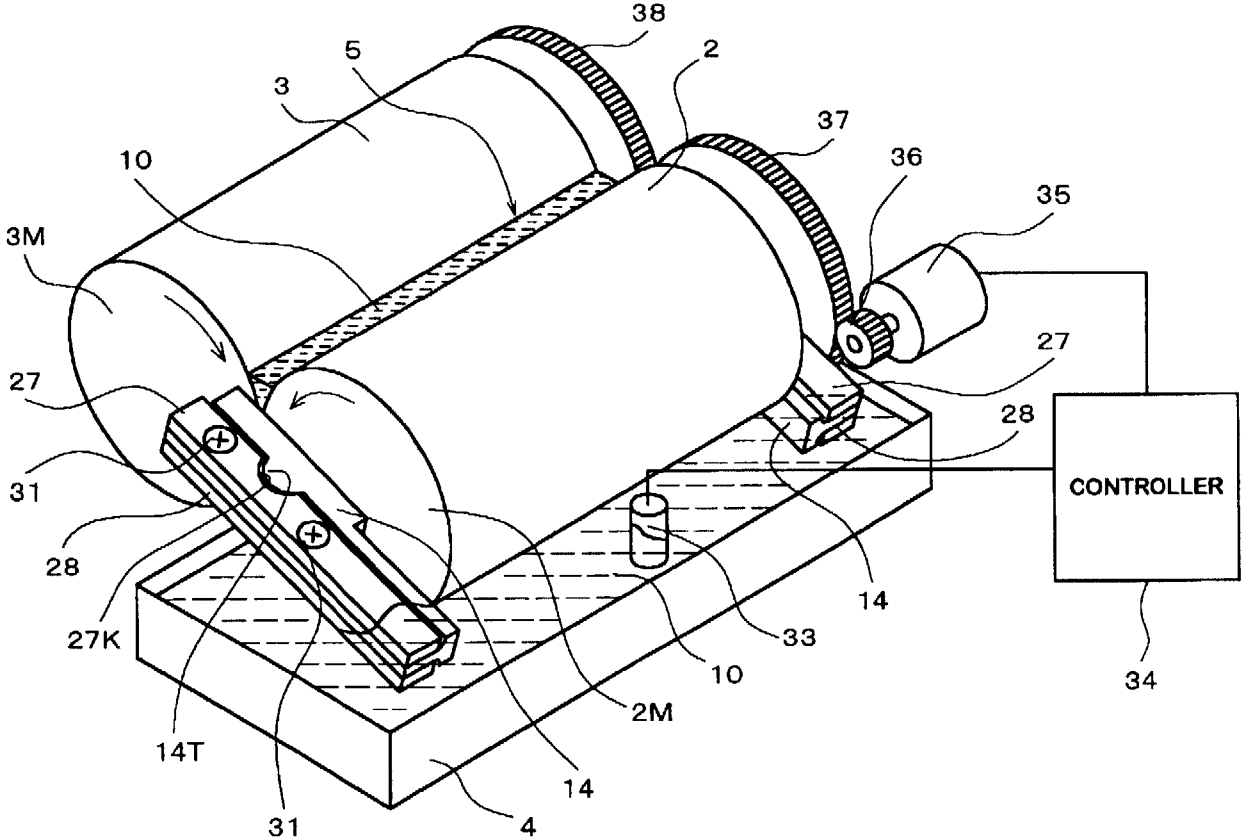
FIG. 4 is a perspective view showing the fourth embodiment of the dampening device in the present invention.
Figure 5:
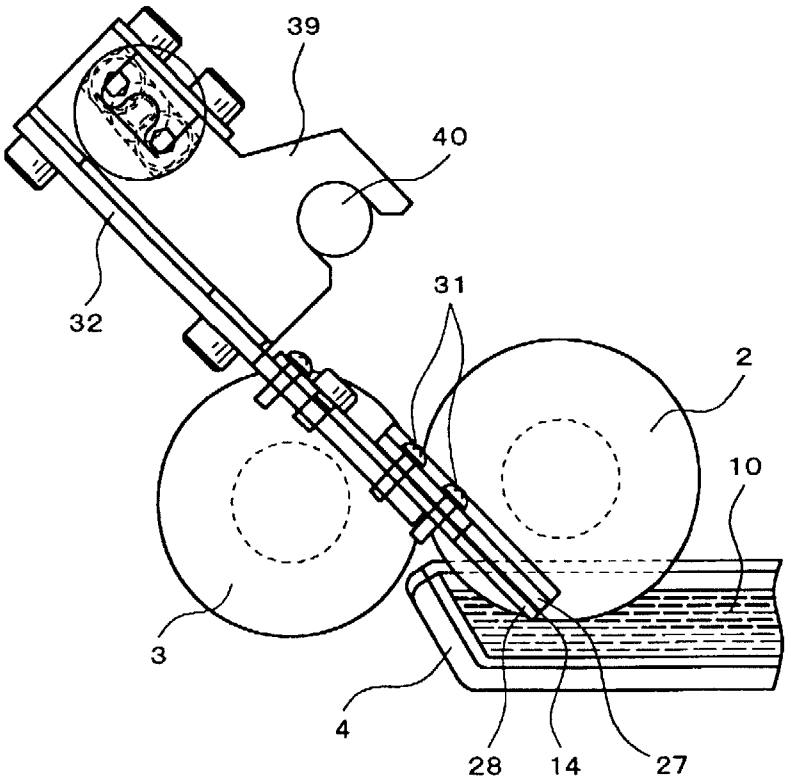
FIG. 5 is a side view showing the fourth embodiment of the dampening device in the present invention.

The fourth embodiment of the dampening device in the present invention will be described in accordance with FIG. 4 and FIG. 5. FIG. 4 is a perspective view of the dampening device in this embodiment, and FIG. 5 is a side view of the dampening device in this embodiment. The wiper 14 (contact member) is interposed between the bracket 27 (first fixing member) and another bracket 28 (second firing member) so as to be fixed therebetween. In addition, the wiper 14 is compressed with both the bracket 27, 28 by screwing the bolts 31 passed therethrough as described in the above embodiments.

Further, cutout part 27K is formed on the bracket 27 in the same manner as the third embodiment described in above. Projection part 14T mated with the cutout part 27K is formed on the wiper 14. The length of the wiper 14, the bracket 27 and the bracket 28 used in this embodiment are formed longer than that of the wipers and brackets used in the previous embodiments. Also, the wiper 14, the bracket 27 and the bracket 28 are arranged so that the forward end of these are soaked in the water fountain 4.

For instance, in a conventional dampening device for the printing machine, the wiper is dried up by evaporation of the dampening solution absorbed in the wiper when the printing machine has not been operated for a certain period of time. The wiper is abraded by friction caused between the wiper thus dried up and the side surface 2M of the water fountain roller 2, and between the wiper and the side surface 3M of the metering roller 3 during re-operation of the printing machine until a sufficient amount of the dampening solution is absorbed in the wiper In order to avoid such a case, the wiper 14 is formed longer than previous embodiments so that the forward end of the wiper 14 to be soaked in dampening solution is stored in the water fountain 4 in this embodiment. Thus, the wiper 14 is always moisturized by the dampening solution even when the printing machine has not been operated in a certain period of time. Therefore, abrasion of the wiper 14 can be avoided by lubrication facilitated with the dampening solution 10 at initial phase of the re-operation of the printing machine.

A gear 37 and another gear 38 are mounted to the water fountain roller 2 and the metering roller 3 respectively, and both gears are arranged so as to engage with each other as shown in FIG. 4. Further, a gear 36 for a motor 35 is engaged with the gear 37. The motor 35 is driven when the printing machine is operated. Thus, dampening solution 10 is supplied to the plate by rotation of the water fountain roller 2 and the metering roller 3.

A sensor 33 as detector is installed in the water fountain 4 in this embodiment. A detection signal generated by the sensor 33 is inputted to a controller 34. The motor 35 is driven by the controller 34 when the detection signal is generated by the sensor 33.

In other words, the wiper 14 is dried up even though the wiper 14 is formed longer than previous ones as in the fourth embodiment when no dampening solution is stored in the water fountain 4.

The sensor 33 is installed in the water fountain 4 in order to prohibit rotation of the water fountain roller 2 and the metering roller 3 when the wiper 14 is dried up.

Thus, abrasion of the wiper 14 can be avoided reliably since both the water fountain roller 2 and the metering roller 3 are rotated when the dampening solution 10 is stored in the water fountain 4.

FIG. 5 is a side view showing detail structure of the fourth embodiment. The wiper 14 interposed between the bracket 27 and the bracket 28 is fixed further to the supporting plate 32 with the bolts 31. The supporting plate 32 is mounted to another bracket 39. Further, the bracket 39 is coupled with a bar 40 provided to the frame of the printing machine. Thus the wiper 14 is connected to the frame of the printing machine via the supporting plate 32, and the bracket 39.

Although the description of the fourth embodiment stated above describes the wiper 14 which contacts both the side surface 2M of water fountain roller 2 and the side surface 3M of the metering roller 3 located on one side of the dampening device, another wiper 14 is located on the other side of the dampening device so as to contact the other side surface 2M of the water fountain roller 2 and the other side surface 3M of the metering roller 3. In other words, a pair of wipers 14 are located so as to contact both the side surfaces 2M of the water fountain roller 2 and the side surfaces 3M of the metering roller 3.

Although the wiper 11, 12, 13 and 14 are used as contact members in the embodiments described above, other structures and materials can be used for the wipers as long as they have elasticity and water retention Further, the brackets 21, 23, 25 and 27 are used as first fixing members, and the brackets 22, 24, 26 and 28 are utilized as second fixing members in the embodiments described above. Other members having different structure can be used as the fixing members as long as the contact member is interposed therebetween.

Although the wipers are fixed by screwing the bolts 31 into the brackets in the embodiments described above, the wiper can be fixed in other ways such as using rivets so as to interpose the wiper between the brackets.

In the dampening device for the printing machine in the present invention, the contact member is provided so as to contact both of the first roller lateral face and the second roller lateral face. The surplus dampening solution stored between the first roller and the second roller is flowed away toward the first roller lateral face and the second roller lateral face.

The dampening solution thus flowed away is scraped off by contacting the contact member with both the first roller lateral face and the second roller lateral face. Thus, the surplus dampening solution is not adhered on the outer surface of the second roller because the surplus dampening solution does not reach to the outer surface of the second roller. And, it is possible to carry out proper printing by preventing oversupply of the dampening solution.

Further, the contact member is made of an elastic body. Thus, the gap formed between the first roller lateral face and the second roller lateral face is covered with the contact member because of elasticity of the contact member even when the position of the first roller lateral face of the first roller and the second roller lateral face of the second roller are arranged so as to be positioned differently from each other in the direction of the roller shafts Hence, proper printing can be carried out by preventing oversupply of the dampening solution as a result of scraping off the surplus dampening solution reliably. In addition, abrasion of the first roller lateral face and the second roller lateral face, both of which are contacted by the contact member, is avoided by composing the contact member with an elastic body.

Still further, the dampening solution is absorbed into the contact member because the contact member has water retention Thus, abrasion of both the first roller lateral face and the second roller lateral face can be avoided more reliably because of lubrication facilitated by the absorbed dampening solution as well as increasing durability of the contact member.

Even further, the contact member is provided simply so as to contact both the first roller lateral face and the second roller lateral face, and no other adjustment is required Thus, the simplified structure described above makes the assembly work easier, so that the manufacturing cost of the dampening device is suppressed. Also, the simplified structure helps to manufacture the dampening device in a small size because not much space for various parts is required.

In the dampening device for the printing machine in the present invention, the contact member is made of a forming material. Thus, it is possible to absorb the dampening solution more reliably.

Further, in the dampening device for the printing machine in the present invention, a part of the contact member is interposed between the first fixing member and the second fixing member so as to be fixed therebetween. Also, concave grooves are formed on the contact member along with one ends of the first fixing member and the second fixing member by applying a force for compressing the part of the contact member with the first fixing member and the second fixing member.

Therefore, the dampening solution absorbed in the contact member can be stored by the concave grooves, thus water retention of the contact member can be increased. As a result, lubrication of the contact member is facilitated.

Still further, in the dampening device for the printing machine in the present invention, a cutout part is formed on both the one ends of the first fixing member and the second fixing member or either of the one ends of the first fixing member or the second fixing member. The projection part is located on the contact member so as to be mated with the cutout part.

Therefore, additional amount of the dampening solution can be absorbed in the contact member because of the projection part, so that water retention of the contact member can be increased further. As a result, lubrication of the contact member is facilitated more and more. Also, it is hard to deform the shape of the contact member by forming the projection part Even further, in the dampening device for the printing machine in the present invention, the contact member is bent toward a direction to be bent by applying a force for compressing a part of the contact member with the first fixing member and the second fixing member under a condition in which both the one ends of the first fixing member and the second fixing member are positioned differently from each other and interposing the part of the contact member.

Thus, the contact member is bent toward the opposite direction to the rotation of the first roller lateral face and the second roller lateral face. So that, the contact member maintains appropriate direction to the first roller lateral face and the second roller lateral face even when the contact member is pulled toward the direction of the rotation of the first roller and the second roller.

Further, in the dampening device for the printing machine in the present invention, the first roller is positioned so as to be soaked in the dampening solution stored in the dampening solution storing part. And at least a part of the contact member is located in a position so as to be soaked in the dampening solution stored in the dampening solution storing part.

Thus, the contact member never will be dried up even when the printing machine is not operated in a certain period of time because the dampening solution stored in the dampening solution storing part is always absorbed into the contact member. Therefore, abrasion of both the first roller and the second roller caused by the contact with a dried contact member can be avoided.

Still further, in the dampening device for the printing machine in the present invention, both the first roller and the second roller are rotated by the control part when the detection signal is generated by the detector.

Thus, both the first roller and the second roller never start rotating when the contact member is dried up. So that, abrasion of both the first roller and the second roller caused by the contact with the dried contact member can be avoided more reliably.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A dampening device for a printing machine comprising:

a first roller rotated by centering around a first roller shaft, and dampening solution being adhered on an outer surface of the first roller, a second roller positioned adjacent to the first roller and being rotated by a second roller shaft located substantially parallel to the first roller shaft, and the dampening solution adhered on the first roller being transferred to an outer surface of the second roller, and a contact member made of an elastic body having water retention, the contact member being provided so as to contact with both of a first roller lateral face and a second roller lateral face, the first roller lateral face being located substantially perpendicular to the first roller shaft of the first roller and the second roller lateral face being located substantially perpendicular to the second roller shaft of the second roller, wherein a part of the contact member is interposed between a first fixing member and a second fixing member so as to be fixed therebetween, and having concave grooves formed on the contact member along with one end of the first fixing member and the second fixing member by a compression force between the part of the contact member with the first fixing member and the second fixing member.

2. A dampening device for a printing machine in accordance with claim 1, wherein the contact member is made of a form material.

3. A dampening device for a printing machine in accordance with claim 1, having a cutout part formed on both the one ends of the first fixing member and the second fixing member or either of the one ends of the first fixing member or the second fixing member, and wherein a projection part is located on the contact member so as to be mated with the cutout part.

4. A dampening device for a printing machine in accordance with claim 1, having the contact member bent toward a direction to be bent by a force for compressing the part of the contact member with the first fixing member and the second fixing member under a condition which both the one ends of the first fixing member and the second fixing member being positioned differently from each other and interposing the part of the contact member, and wherein the direction to be bent is a direction opposite to rotation of the first roller lateral face and the second roller lateral face both of which being contacted to the contact member.

5. A dampening device for a printing machine in accordance with claim 1, wherein the dampening device further comprises a dampening solution storing part for storing the dampening solution, and wherein the first roller is positioned so as to be soaked in the dampening solution stored in the dampening solution storing part, and wherein at least a part of the contact member is located in a position so as to be soaked in the dampening solution stored in the dampening solution storing part.

6. A dampening device for a printing machine in accordance with claim 5, wherein the dampening device further comprises a control part for controlling rotation of the first roller and the second roller and a detector for generating a detection signal when the dampening solution is stored in the dampening solution storing part, and wherein both the first roller and the second roller are rotated by control of the control part when the detection signal is generated by the detector.

* * * * *